United States Patent [19]

Morgan

[11] 4,070,719

[45] Jan. 31, 1978

[54] CUSHIONING ELEMENT

[75] Inventor: Charles W. Morgan, Rolling Hills, Calif.

[73] Assignee: The Dow Chemical Company, Midland, Mich.

[21] Appl. No.: 719,498

[22] Filed: Sept. 1, 1976

[51] Int. Cl.[2] ..... A47C 27/08

[52] U.S. Cl. ..... 5/355; 5/345 R; 5/361 B

[58] Field of Search ..... 5/345 R, 355, 361 R, 5/361 B; 297/DIG. 1

[56] References Cited

U.S. PATENT DOCUMENTS

| | | | |
|---|---|---|---|
| 3,512,190 | 5/1970 | Buff | 5/361 B |
| 3,641,601 | 2/1972 | Sieg | 5/345 R |
| 3,885,257 | 5/1975 | Rogers | 5/361 R |
| 3,974,532 | 8/1976 | Ecchuya | 5/345 R |

*Primary Examiner*—Casmir A. Nunberg
*Attorney, Agent, or Firm*—R. B. Ingraham

[57] ABSTRACT

An improved cushioning element is provided which is prepared from a synthetic resinous cellular resilient body. A plurality of intersecting grooves are formed in the surface of the cushioning element thereby providing a body-supporting surface of a plurality of spaced-apart bosses generally independently deflectable and recoverable.

5 Claims, 5 Drawing Figures

CUSHIONING ELEMENT

Synthetic foam cushioning elements have been employed for seating, mattresses and other comfort applications for many years. Such cushioning elements have been prepared from foam rubber compositions and molded into a wide variety of configurations. Other popular synthetic resinous cushioning bodies are the so-called flexible polyurethane foams. Bodies prepared from foam rubber and flexible urethane foams have been shaped into principal cushioning elements for various pieces of furniture. Oftentimes, in order to reduce the apparent density of the cushioning element, such cushioning elements have been prepared which define a plurality of recesses, often of generally cylindrical configuration extending inwardly from one or more of the surfaces thereof. Oftentimes, the density of the synthetic cushioning element provides a texture, consistency or degree of firmness different from that which is desired. In some instances, a plurality of slits have been formed in the cushioning body in order to provide a softer cushioning element. In the production of cushioning elements such as mattresses, usually it is desirable to provide such articles with a varying degree of firmness or resistance to deflection under the load provided a body resting thereon. Generally, it is desirable to provide other cushioning elements in varying degrees of firmness. Often, to provide such varying degrees of firmness, it is necessary to mold cushioning element in different molds which provide a configuration which gives the different degrees of firmness desired or to alter a foam-forming composition to provide foamed cushioning elements of varying density and consequently varying firmness. In many instances synthetic foam cushioning elements are found undesirable by users because perspiration does not readily evaporate from a location between the user's body and the cushioning element.

It would be desirable if there were available an improved synthetic foam cushioning element.

It would be desirable if there were available an improved synthetic foam cushioning element which could be readily prepared in varying degrees of firmness.

It would also be desirable if there were available an improved synthetic resinous cushioning element which permitted improved air circulation when the user's, body was in contact with the cushioning element.

It would also be desirable if there were available an improved synthetic resinous mattress cushioning element.

These benefits and other advantages in accordance with the present invention are achieved in a cushioning element for seating or sleeping of humans and the like, the cushioning element having a synthetic resinous resilient cellular cushioning body, the cushioning body having at least a principal human body supporting face adapted to be disposed adjacent a human body when the cushioning element is in use, the cushioning body defining a plurality of grooves, the plurality of grooves extending into the body and dividing the body-supporting face and a portion of the body adjacent to the body-supporting face into a plurality of adjacent, spaced-apart bosses with the further limitation the bosses are individually deflectable and exhibit individual recovery when a deflecting force is applied and removed respectively, thereby providing a grooved body-supporting face of a plurality of body-supporting bosses each at least partially deformable independent of adjacent body-supporting bosses.

Further features and advantages of the present invention will become more apparent from the following specification taken in connection with the drawing wherein.

Figure 1:
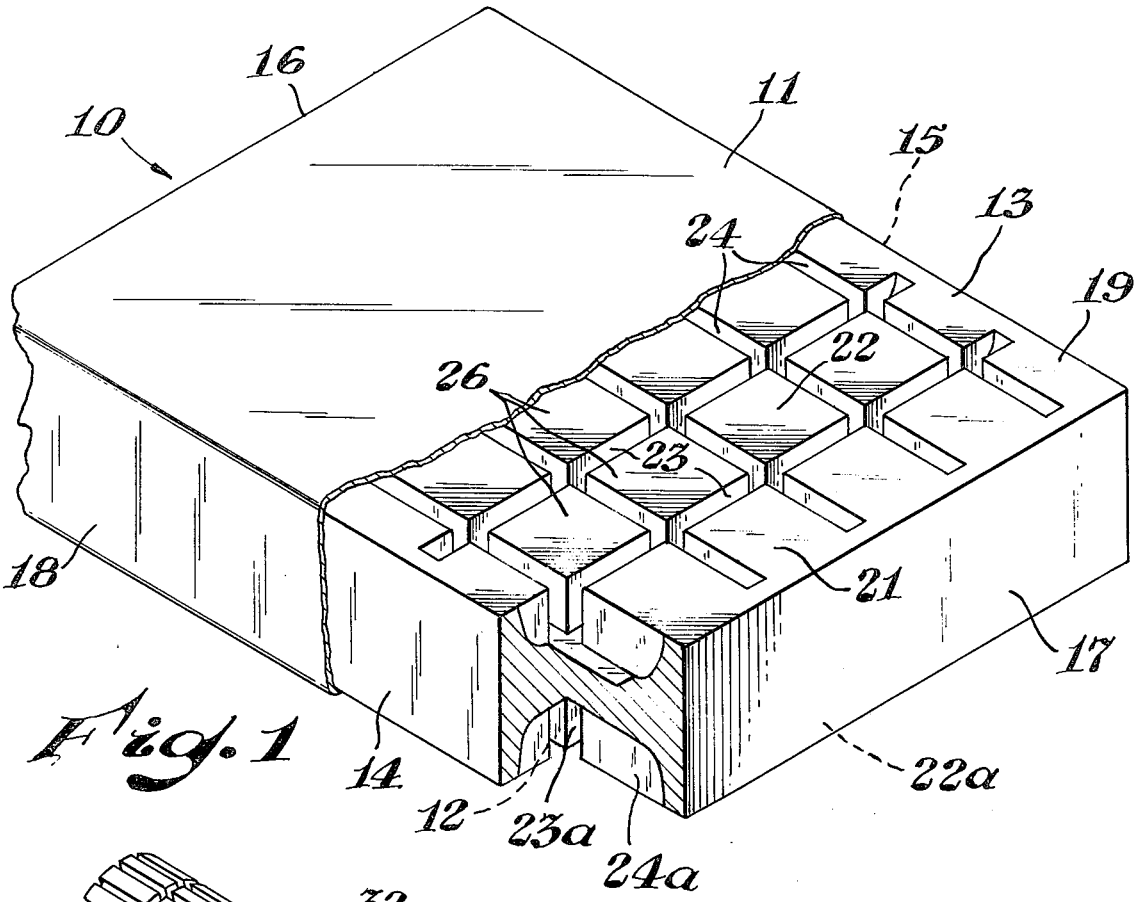
FIG. 1 is a schematic, partly-in-section representation of a mattress in accordance with the present invention.

In FIG. 1 there is schematically depicted a cushioning element or mattress in accordance with the present invention generally designated by the reference numeral 10. The mattress 10 has a generally rectangular configuration, a first or upper major surface 11 and a second or lower major surface 12. The mattress 10 has a periphery 13, sides 14, 15 and ends 16 and 17. The mattress 10 comprises a mattress cover 18 of conventional fabric and padding construction and a mattress core or cushioning element 19. the cushioning element 19 has a generally rectangular configuration, edges and sides corresponidng to those of the mattress 10 and a first major face 21 and a second major face 22. The cushioning element 19 is prepared of a synthetic resilient foam such as a composite foam as disclosed in U.S. Pat. No. 3,878,133 which has a plurality of individual foamed synthetic resinous particles dispersed throughout a synthetic resinous matrix such as polyurethane foam. The teaching of U.S. Pat. No. 3,878,133 is herewith incorporated by reference thereto. The cushioning element 19 on a first face 22 has defined therein a first plurality of grooves 23 extending generally from side-to-side and a second plurality of grooves 24 extending generally from end-to-end. The grooves 23 and 24 as depicted in FIG. 1 are disposed generally at right angles to each other and extend unto the cushioning element in a direction mormal to the surface 22. As illustrated in FIG. 1, the grooves 23 and 24 do not extend for the entire width and length respectively of the mattress element 10 but terminate at a location generally adjacent the ends and edges of the cushioning element. The grooves 23 and 24, in effect, divide the cushioning element or body surface into a plurality of generally independent bosses 26 which are separated from each other by the grooves and connected to each other only at a location remote from the bodysupporting surface such as the surface 22a. A similar set of grooves 23a are disposed on face 22a opposed to face 22 of the cushioning element 17.

By the appropriate choice of groove width and groove depth, varying degrees of firmness can be obtained. Generally it is desirable in a mattress element employing a synthetic resinous foam to use a groove width of from about one-eighth of an inch to three-eighths of an inch and preferably from one-eighth to one-fourth inch, the depth of the groove of from one-half to two and one-half inches and when employed in a rectangular pattern such as depicted in FIG. 1, adjacent grooves are spaced on about two and one-half to about four inch centers. Generally it is desirable to maintain the groove sufficiently wide that the independent bosses such as the bosses 26 can be deflected and recovered independently. If, for example, the grooves of the cushioning element such as depicted in FIG. 1 have zero width, in many foam cushioning material individual elements can be depressed below the level of adjacent neighbors and will not recover when the load is removed due to frictional engagement with adjacent uncompressed foam adjacent the edges or sides of the depressed boss. By providing a groove width of at least an eighth of an inch such action is avoided and each element or boss acts as a more or less independent cushioning element when subjected to a load sufficient to cause minor compression. The groove width also contributes substantially to comfort as the groove is a route for the escape of moisture. Advantageously, the grooves such as the grooves 23 and 24 do not extend entirely across the major faces of a mattress such as the mattress 10 but terminate adjacent the edge thereby providing a mattress having a peripheral or edge portion which is significantly more resistant to compression than the grooved area. Such edge stiffness generally is very desirable in a mattress where occasionally it will be used as a seat and avoids a soft edge configuration which, in general, for comfort purposes is undesirable.

Figure 2:
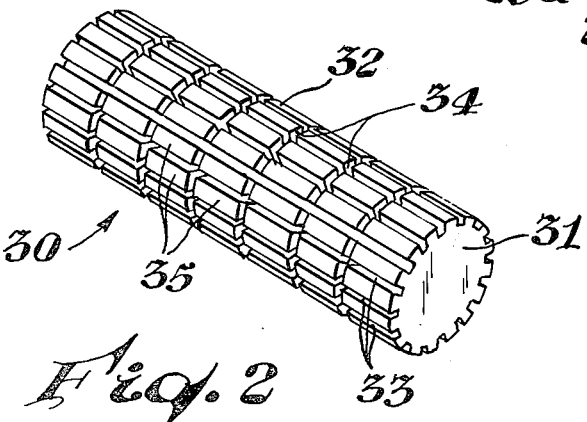
FIG. 2 is a schematic representation of an alternate embodiment of the present invention.

An alternate embodiment of the present invention is depicted in FIG. 2 which is a bolster cushioning element generally designated by the reference numeral 30. The cushioning element 30 has a generally cylindrical body portion 31 and a cylindrical exterior cushioning surface 32. The body defines a first plurality of generally axially extending grooves 33 disposed on the cylindrical surface 32 of the body 31. A second series of generally annular outwardly facing grooves 34 extend circumferentially about the body 31 and intersect the grooves 33 to provide a plurality of bosses 35. For a bolster cushioning element such as the element 30 of FIG. 2, generally it is desirable to maintain the groove width at least about an eighth of an inch, however, the depth and spacing are primarily a matter of personal choice depending upon the rigidity of the final bolster desired.

Figure 3:
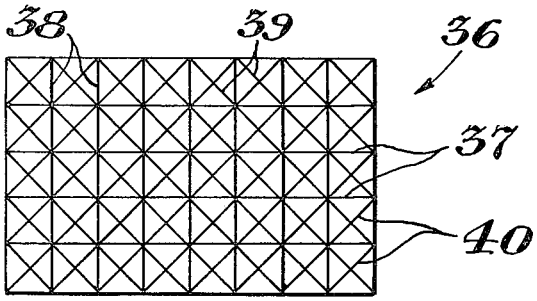

In FIG. 3 there is depicted schematically the groove pattern useful for the practice of the present invention generally designated by the reference numeral 36. The pattern 36 has two sets of grooves 37 and 38 generally disposed at right angles and a second set of parallel slits 39 and 40 also disposed at right angles to each other but displaced 45° from the grooves 37 and 38, the grooves 37, 38, 39 and 40 all having common points of intersection.

Figure 4:
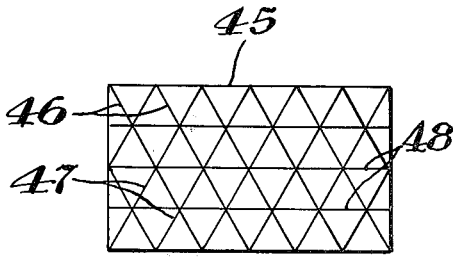
FIGS. 3, 4 and 5 depict alternate slit configurations useful for the present invention.

In FIG. 4 there is schematically depicted an alternate groove pattern useful for the present invention generally designated by the reference numeral 45. Three series of parallel grooves are employed, grooves designated 46, 47 and 48. The three groups of parallel grooves are disposed at about 60° to each other to form a plurality of bosses having the configuration of an equilateral triangle.

Figure 5:
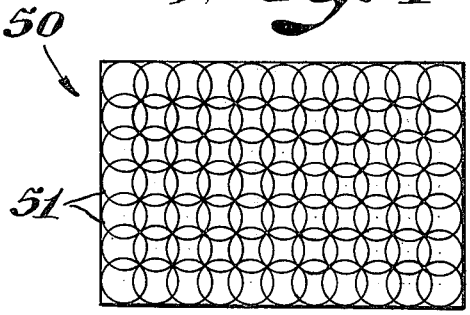

In FIG. 5 there is depicted an alternate pattern of grooves useful in the present invention designated by the reference numeral 50. The pattern comprises a plurality of overlapping circles 51 whose centers lie on a square grid, each square of the grid having a side less than the diameter of the circle.

Generally in the preparation of the cushioning elements in accordance with the present invention, the number and arrangement of the grooves is dependent on the softness desired in the cushioning element, for example, the pattern of FIG. 5 employing circles of about two inches in diameter such as might be cut with a hole saw by moving a rapidly rotating saw into the foam, but not through the foam, will provide a cushioning element with greater initial defletion under minor load than if the pattern of FIG. 4 is employed wherein the spacing of the parallel grooves is three inches. For the preparation of mattresses and most cushioning elements, the pattern of FIG. 1 is particularly desirable because of the ease and rapidity with which it can be formed. Cushioning foams can be grooved employing a plurality of circular saws of equal diameter on a single rotating mandrel. The saw blades being spaced apart the desired distance, the saw blades can then be plunged into the foam to the desired depth, the foam moved relative to the saw blades to provide grooves of the desired length, width and depth. With some varieties of foam it is preferred to employ abrasive wheels in place of saw blades if, in general, a smoother finished groove is obtained.

As is apparent from the foregoing specification, the present invention is susceptible of being embodied with various alterations and modifications which may differ particularly from those that have been described in the preceding specification and description. For this reason, it is to be fully understood that all of the foregoing is intended to be merely illustrative and is not to be construed or interpreted as being restrictive or otherwise limiting of the present invention, excepting as it is set forth and defined in the hereto-appended claims.

What is claimed is:

1. A cushioning element for seating or sleeping of humans and the like, the cushioning element having a synthetic resinous resilient cellular cushioning body, the cushioning body having ends and edges at least a principal human body-supporting face adapted to be disposed adjacent a human body when the cushioning element is in use, the cushioning body defining on the body-supporting face a plurality of grooves, the grooves having a width of from about one-eighth to about three-eighths of an inch, the plurality of grooves extending into the body and dividing the body-supporting face and a portion of the body adjacent to the body-supporting face into a plurality of adjacent spaced-apart bosses the grooves terminating at a location adjacent the ends and edges thereby providing an edge portion which is more resistant to compression than the area having grooves with the further limitation the bosses are individually deflectable and exhibit individual recovery when a deflecting force is applied and removed respectively, thereby providing a body-supporting face of a plurality of body-supporting face bosses each at least partially deformable independent of adjacent body-supporting face bosses.

2. The cushioning element of claim 1 in the form of a generally planar slab.

3. The cushioning element of claim 2 having the form of a mattress.

4. The cushioning element of claim 3 having a generally continuous covering over the body-supporting surface.

5. A mattress for the support of the human body, the mattress comprising a mattresscover generally enclosing a synthetic resinous resilient cellulose cushioning body, the cushioning body having ends and edges, at least a principal human body-supporting face adapted to be disposed adjacent a human body when the cushioning element is in use, the cushioning body defining on the body supporting face a plurality of grooves, the plurality of grooves extending into the body and dividing the body-supporting face and a portion of the body adjacent to the body-supporting face into a plurality of adjacent spaced-apart bosses with the further limitation the bosses are individually deflectable and exhibit individual recovery when a deflecting force applied and romoved is removed respectively, thereby providing a body-supporting face of a plurality of body-supporting face bosses each at least partially deformable independent of adjacent body-supporting face bosses the grooves terminating at a location adjacent the ends and edges thereby providing an edge portion which is more resistant to compression than the area having grooves with the further limitation that the grooves have a width from about one-eighth of an inch to three-eighths of an inch, the grooves are from one-half to two and one-half inches in depth and are spaced on centers of from about two and one-half to about four inches.

* * * * *